US011519579B2

(12) United States Patent
Kang et al.

(10) Patent No.: US 11,519,579 B2
(45) Date of Patent: Dec. 6, 2022

(54) LAMP FOR VEHICLE

(71) Applicant: SL Corporation, Daegu (KR)

(72) Inventors: Da Il Kang, Gyeongsan-si (KR); Sun Kyoung Park, Gyeongsan-si (KR); Sang Hwa Lee, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/371,157

(22) Filed: Jul. 9, 2021

(65) Prior Publication Data

US 2022/0049831 A1 Feb. 17, 2022

(30) Foreign Application Priority Data

Aug. 13, 2020 (KR) ..... 10-2020-0101654

(51) Int. Cl.

| | |
|---|---|
| ***F21S 41/33*** | (2018.01) |
| ***F21S 41/265*** | (2018.01) |
| ***F21V 5/04*** | (2006.01) |
| ***F21V 5/00*** | (2018.01) |
| ***F21S 43/31*** | (2018.01) |
| ***F21S 43/20*** | (2018.01) |
| ***F21V 5/02*** | (2006.01) |

(Continued)

(52) U.S. Cl.

CPC ..... *F21S 41/334* (2018.01); *F21S 41/265* (2018.01); *F21S 41/33* (2018.01); *F21S 41/331* (2018.01); *F21S 41/332* (2018.01); *F21S 41/333* (2018.01); *F21S 41/335* (2018.01); *F21S 41/336* (2018.01); *F21S 41/337* (2018.01); *F21S 41/338* (2018.01); *F21S 43/20* (2018.01); *F21S 43/26* (2018.01); *F21S 43/30* (2018.01); *F21S 43/315* (2018.01); *F21S 43/40* (2018.01); *F21V 5/002* (2013.01); *F21V 5/004* (2013.01); *F21V 5/005* (2013.01); *F21V 5/02* (2013.01); *F21V 5/045* (2013.01); *F21V 7/048* (2013.01); *F21V 7/09* (2013.01)

(58) Field of Classification Search

CPC ..... F21S 41/265; F21S 41/334; F21S 41/335; F21S 41/336; F21S 41/322; F21S 41/338; F21S 41/337; F21S 41/33; F21S 41/323; F21S 41/321; G02B 3/0056; G02B 3/0043; G02B 3/0062; G02B 3/0068

See application file for complete search history.

(56) References Cited

U.S. PATENT DOCUMENTS 1,618,010 A * 2/1927 Hoss ..... F21S 41/337 362/348
6,244,731 B1 * 6/2001 Koiko ..... F21S 41/28 362/297

(Continued)

FOREIGN PATENT DOCUMENTS

DE 102018132065 A1 * 6/2020 ..... G02B 5/005

*Primary Examiner* — Colin J Cattanach

(74) *Attorney, Agent, or Firm* — United One Law Group LLC; Kongsik Kim; Jhongwoo Peck

(57) ABSTRACT

A vehicle lamp includes a light source system; a reflection system including a plurality of reflective faces to reflect light beams emitted from the light source system to travel forward; and an optical system including a plurality of lenses respectively corresponding to the plurality of reflective faces. The optical system is configured to transmit at least a portion of light reflected from each of the plurality of reflective faces through a corresponding lens among the plurality of lenses to form a predetermined light irradiation pattern.

15 Claims, 17 Drawing Sheets

(51) Int. Cl.

| | |
|---|---|
| ***F21V 7/09*** | (2006.01) |
| ***F21S 43/30*** | (2018.01) |
| ***F21V 7/04*** | (2006.01) |
| ***F21S 43/40*** | (2018.01) |

(56) References Cited

U.S. PATENT DOCUMENTS

| | | | | |
|---|---|---|---|---|
| 11,047,543 | B1 * | 6/2021 | Potter | F21S 41/10 |
| 2008/0175015 | A1 * | 7/2008 | Goncalves | F21V 7/09<br>362/268 |
| 2011/0075437 | A1 * | 3/2011 | Wang | F21S 41/17<br>362/538 |
| 2013/0242589 | A1 * | 9/2013 | Abe | F21S 41/26<br>362/512 |
| 2018/0106450 | A1 * | 4/2018 | Kamau | F21S 41/265 |
| 2018/0335191 | A1 * | 11/2018 | Stefanov | F21S 41/635 |

* cited by examiner

LAMP FOR VEHICLE

CROSS-REFERENCE TO RELATED APPLICATION

This application claims priority to Korean Patent Application No. 10-2020-0101654 filed on Aug. 13, 2020, which application is herein incorporated by reference in its entirety.

BACKGROUND

1. Technical Field

The present disclosure relates to a lamp for a vehicle, and more particularly, to a lamp for a vehicle that forms an appropriate light irradiation pattern while an overall size of the lamp is reduced due to a simplified configuration thereof.

2. Description of Related Art

A vehicle is equipped with various types of the lamps having an illumination function to easily identify objects located around the vehicle during low light conditions (e.g., night driving), and a signaling function to inform a driver of another vehicle or a pedestrian around the vehicle of a driving state of the vehicle.

For example, head lamps and fog lamps are mainly intended for the illumination functions. Turn signal lamps, tail lamps, brake lamps, etc. are mainly for the signaling functions. Installation standards of the lamps and standards of the lamps are stipulated by laws and regulations to fully exhibit corresponding functions.

Recently, research to reduce a size of the lamp using a micro-lens with a relatively short focal point distance is being actively conducted. In this case, light emitted from the light source is converted into parallel light using a collimator lens. As the converted parallel light passes through an input lens and an output lens corresponding to each other, an appropriate light irradiation pattern is formed.

As a size of the micro-lens is decreased, difficulties in a manufacturing process may occur. Further, a manufacturing cost thereof increases, thereby causing a limit in reducing the size of the micro-lens. Thus, there is also a limit to reducing a size of each of the input lens and output lens including the collimator lens.

Therefore, there is a need for a lamp to form an appropriate light irradiation pattern while a size of the lamp using the micro-lens is reduced to reduce an installation space.

SUMMARY

An object of the present disclosure is to provide a lamp for a vehicle in which light emitted from a light source is reflected from a plurality of reflective faces and subsequently proceeds to a corresponding micro-lens, such that an appropriate light irradiation pattern is formed while an overall size of the lamp is reduced.

Objects in accordance with the present disclosure are not limited to the above-mentioned object. Other objects and advantages in accordance with the present disclosure as not mentioned above may be understood from following descriptions and more clearly understood from embodiments in accordance with the present disclosure. Further, it will be readily appreciated that the objects and advantages in accordance with the present disclosure may be realized by features and combinations thereof as disclosed in the claims.

According to an aspect of the present disclosure, a vehicle lamp may include a light source system; a reflection system including a plurality of reflective faces to reflect light beams emitted from the light source system to travel forward; and an optical system including a plurality of lenses respectively corresponding to the plurality of reflective faces. In particular, the optical system may be configured to transmit at least a portion of light reflected from each of the plurality of reflective faces through a corresponding lens among the plurality of lenses to form a predetermined light irradiation pattern.

Among the plurality of reflective faces, a first reflective face that is farther from the light source system than a second reflective face may be disposed closer to the optical system than the second reflective face. Each of the plurality of reflective faces may be configured such that as a distance between each reflective face and the light source system increases, an angle defined by a line connecting a front end of the each reflective face to the light source system and a line connecting a rear end of the each reflective face to the light source system decreases. Each of the plurality of reflective faces may be configured such that as a distance between each reflective face and the light source system increases, a length between front and rear ends of the each reflective face increases.

The light source system may be disposed at a first focal point of the plurality of reflective faces, and a second focal point of each of the plurality of reflective faces may be disposed in front of the each of the plurality of reflective faces. A second focal point of one reflective face among the plurality of reflective faces may be formed at a position different from a second focal point of another reflective face among the plurality of reflective faces.

Further, the optical system may also include a plurality of shields for blocking some of the light beams from being respectively directed to the plurality of lenses. Each of the plurality of shields may include a transmissive region through which light transmits; and a blocking region to block light, and a position of the second focal point of each of the plurality of reflective faces may be determined based on a size of the transmissive region.

The second focal point of each of the plurality of reflective faces may be disposed such that a size of a propagation face through which light reflected from each of the plurality of reflective faces is propagated may be larger than the size of the transmissive region. The second focal point of each of the plurality of reflective faces may be disposed such that a closed curve defining the transmissive region is encompassed by a closed curve defining the propagation face. The second focal point of at least one of the plurality of reflective faces may be disposed in front of a corresponding shield among the plurality of shields.

At least one of a size or a shape of the transmissive region of some of the plurality of shields may be different from some other of the plurality of shields. A size of the transmissive region of some of the plurality of shields may be smaller than some other of the plurality of shields, and among the plurality of shields, a first shield that has a smaller transmissive region than a second shield may be disposed farther from the light source system than the second shield.

The optical system may further include an optical member having an incident surface and an exit surface, wherein the plurality of shields are formed on the incident surface thereof, while the plurality of lenses are formed on the exit surface thereof. A length of the optical member in a front and rear direction may be determined based on a distance between the plurality of lenses and the plurality of shields corresponding to the plurality of lenses. The optical system may further include a light transmitter disposed in rear of the optical member, wherein an exit surface of the light transmitter is in contact with the incident surface of the optical member. The plurality of shields may be interposed between the exit surface of the light transmitter and the incident surface of the optical member.

The optical system may be configured to output the light beams in a plurality of different directions so that the light irradiation pattern includes a plurality of pattern images formed at different positions. Exit surfaces of the plurality of lenses of the optical system may have different curvatures based on directions in which the light beams exit therefrom.

According to the lamp for the vehicle according to the present disclosure as described above, one or more of the following effects may be provided. The plurality of reflective faces may direct the light emitted from the light source system to a corresponding lens among the plurality of lenses of the optical system, thereby reducing the overall size of the lamp. Further, a desired light irradiation pattern may be formed by adjusting a position of a focal point of each of the plurality of reflective faces based on a position of each of the plurality of reflective faces. In addition to the effects as described above, specific effects in accordance with the present disclosure will be described together with the detailed description for carrying out the disclosure.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
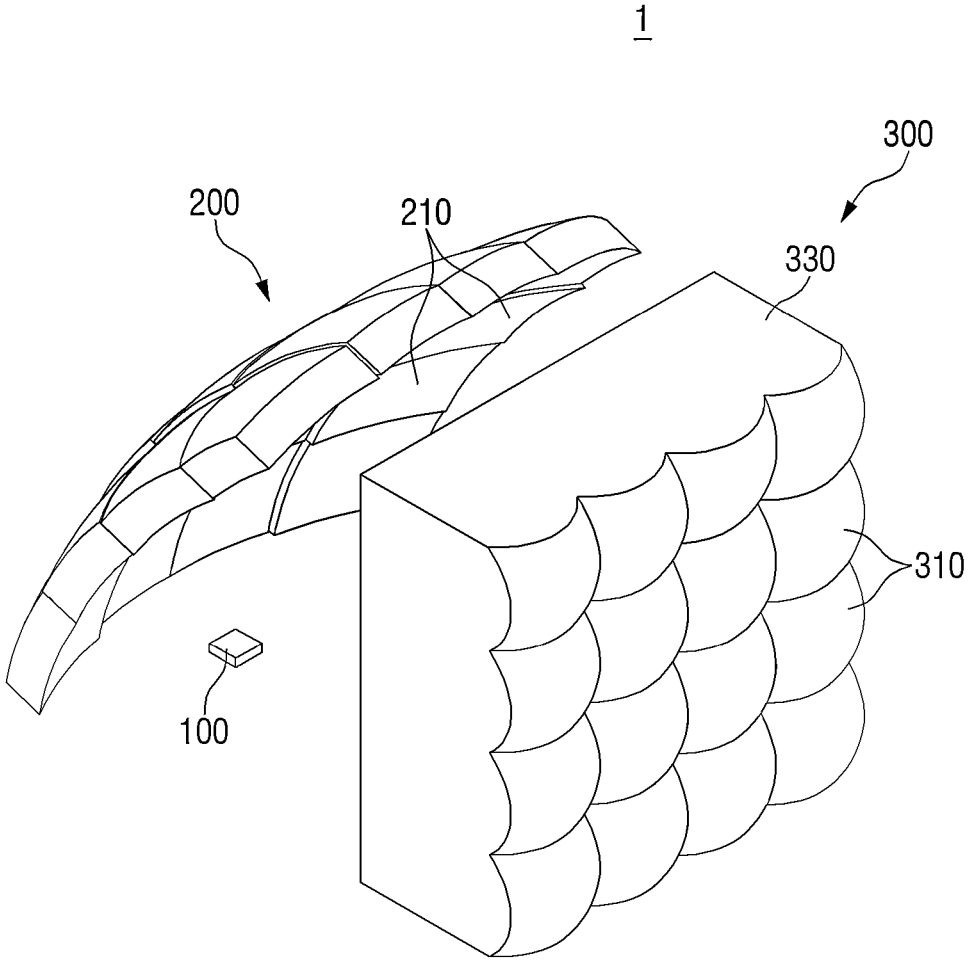
FIGS. 1 and 2 are perspective views showing a lamp for a vehicle according to an exemplary embodiment of the present disclosure.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Throughout the specification, like reference numerals in the drawings denote like elements.

In some embodiments, well-known steps, structures and techniques will not be described in detail to avoid obscuring the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for describing a lamp for a vehicle based on implementations of the present disclosure.

Figure 2:
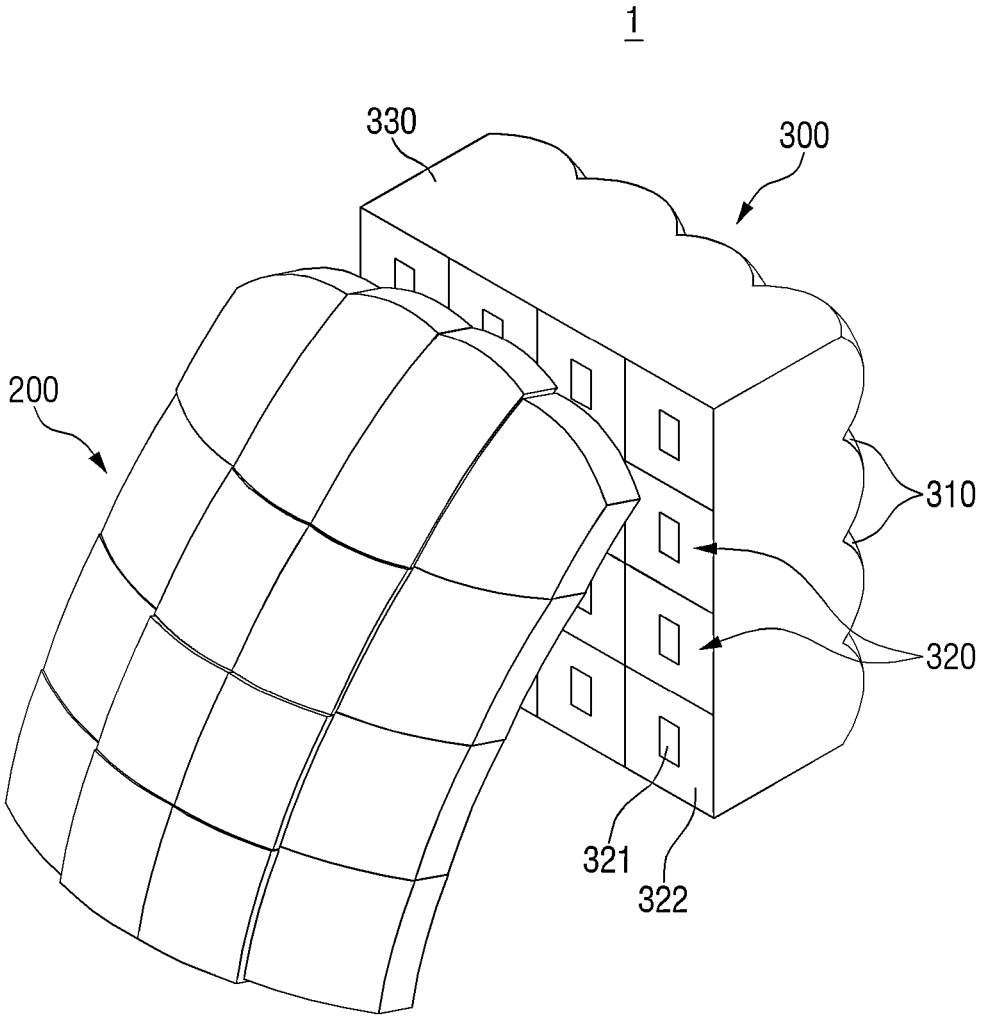
Figure 3:
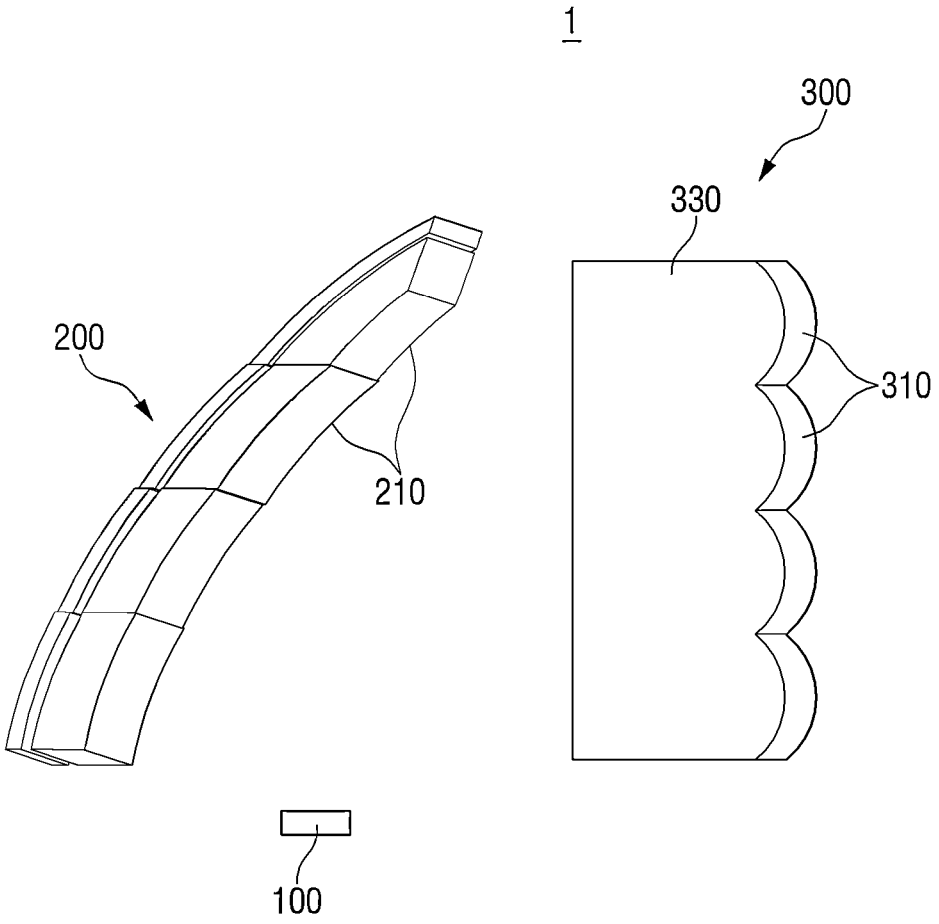
FIG. 3 is a side view showing a lamp for a vehicle according to an exemplary embodiment of the present disclosure.

FIGS. 1 and 2 are perspective views showing a lamp for a vehicle according to an implementation of the present disclosure. FIG. 3 is a side view showing a lamp for a vehicle according to an implementation of the present disclosure. Referring to FIGS. 1-3, a lamp 1 for a vehicle according to an implementation of the present disclosure may include a light source system 100, a reflection system 200, and an optical system 300. The light source system 100, the reflection system 200, and the optical system 300 may be accommodated in an interior space defined by a lamp housing (not shown) and a cover lens (not shown) that is coupled to the lamp housing (not shown) to irradiate light outside the vehicle.

In an implementation of the present disclosure, the lamp 1 for the vehicle may have a variety of functions including an illumination function such as a function of a head lamp that ensures a driver's field of view when driving the vehicle in low light conditions (e.g., at night), a signaling function such as a function of a position lamp, a daytime running lamp (DRL), a turn signal lamp, a brake lamp, etc. that informs another driver or a pedestrian of the driving state of the vehicle, and a function to display an image representing various information that drivers of nearby vehicles or pedestrians need to recognize on a road surface around the vehicle. The lamp 1 for the vehicle according to the present disclosure may have a single function among the above-described functions, or may have a combination of two or more functions thereof.

Hereinafter, in an implementation of the present disclosure, an example in which the lamp 1 for the vehicle according to the present disclosure forms a light irradiation pattern including at least one pattern image having a predefined size on a road surface around the vehicle will be described. However, the present disclosure is not limited thereto. The present disclosure may be applied to a case where the lamp 1 for the vehicle according to the present disclosure forms a light irradiation pattern for an illumination function or a signaling function.

The light source system 100 may include at least one light source that emits light having a color and/or brightness suitable for the function of the lamp 1 for the vehicle according to the present disclosure. In an implementation of the present disclosure, a case where a semiconductor light emission device such as a light emitting diode (LED) is used as the at least one light source will be described by way of example. However, the present disclosure is not limited thereto. The at least one light source may employ not only an LED, but also various types of light sources such as a bulb or a laser diode (LD). Optical elements such as mirrors, prisms, lenses, and reflectors that affect light properties such as brightness or a path of light may be additionally used depending on a type of the light source.

The light source system 100 may be positioned so that light is emitted therefrom upward or downward such that the light is reflected from the reflection system 200 and proceeds forward. In an implementation of the present disclosure, a case where the light is emitted in an upward direction from the light source system 100 will be described by way of example. Herein, the terms "upward" or "downward" directions are used with reference to the orientation shown in the drawings. The actual and absolute directions may be varied based on the installation orientation of the lamp 1 in the vehicle.

The reflection system 200 may include a plurality of reflective faces 210 that reflect light emitted from the light source system 100. The plurality of reflective faces 210 may be arranged in a vertical direction so that the light emitted from the light source system 100 may be reflected therefrom and may proceed forward.

A configuration that the plurality of reflective faces 210 are arranged in the vertical direction may include not only a configuration that a single column of the plurality of reflective faces 210 is formed along the vertical direction, but also a configuration that the plurality of reflective faces 210 are arranged in a row that extends in the left and right direction, that is, a horizontal direction, and a configuration that the plurality of reflective faces 210 are arranged in a matrix or array shape including rows and columns.

Due to the plurality of reflective faces 210 being arranged in the vertical direction in an implementation of the present disclosure, the light may be emitted from the light source system 100 upward or downward. In this regard, a direction in which the plurality of reflective faces 210 are arranged may vary according to a direction in which the light is emitted from the light source system 100.

The plurality of reflective faces 210 may have different positions in the front and rear direction, based on distances therefrom to the light source system 100. Due to the configuration where the positions of the plurality of reflective faces 210 in the front and rear direction are different from one another, the light emitted upward from the light source system 100 may reach all of the plurality of reflective faces 210. More specifically, the plurality of reflective faces 210 may be disposed closer to the optical system 300 as the distances therefrom to the light source system 100 increases. In order words, among the plurality of reflective faces 210, a first reflective face that is farther from the light source system than a second reflective face may be disposed closer to the optical system than the second reflective face. Accordingly, the light emitted from the light source system 100 may reach all of the plurality of reflective faces 210.

In this regard, each reflective face 210 may include opposing ends in the front and rear direction, that is, front and rear ends. Thus, each reflective face 210 may exhibit an angle θ between a line connecting the light source system 100 to the front end of the reflective face 210 and a line connecting the light source system 100 to the rear end of the reflective face 210. Accordingly, the plurality of reflective faces 210 may have different angles, such that the light beams respectively reflected from the plurality of reflective faces 210 may proceed forward.

Figure 4:
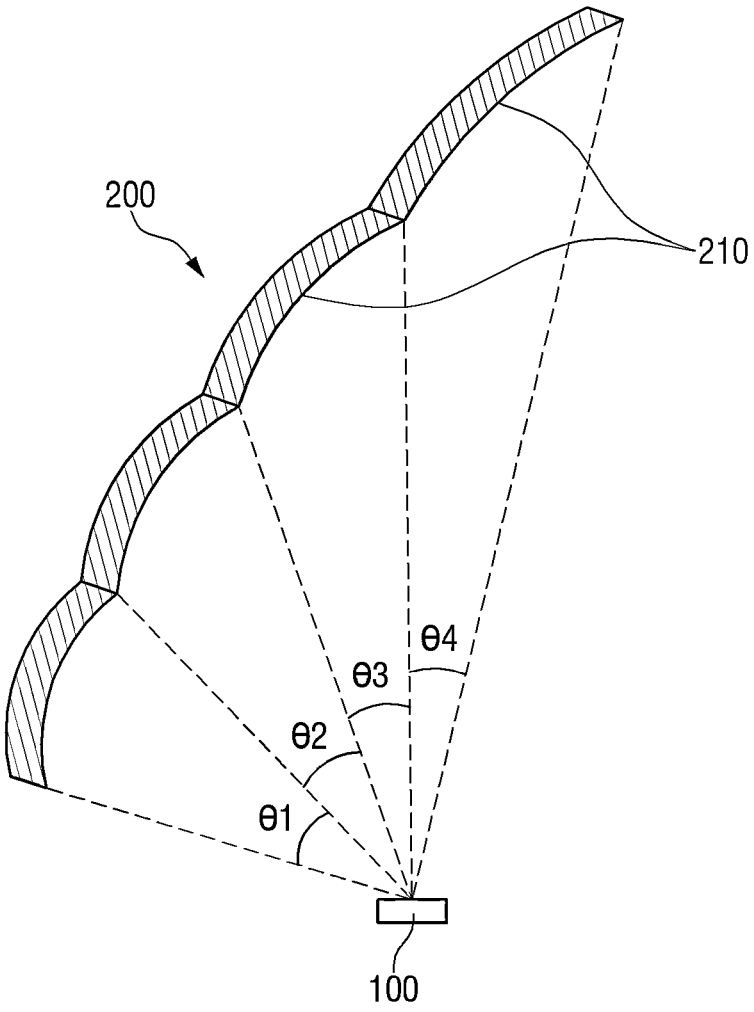
FIGS. 4 and 5 are schematic diagrams showing a plurality of reflective faces according to an exemplary embodiment of the present disclosure.
Figure 5:
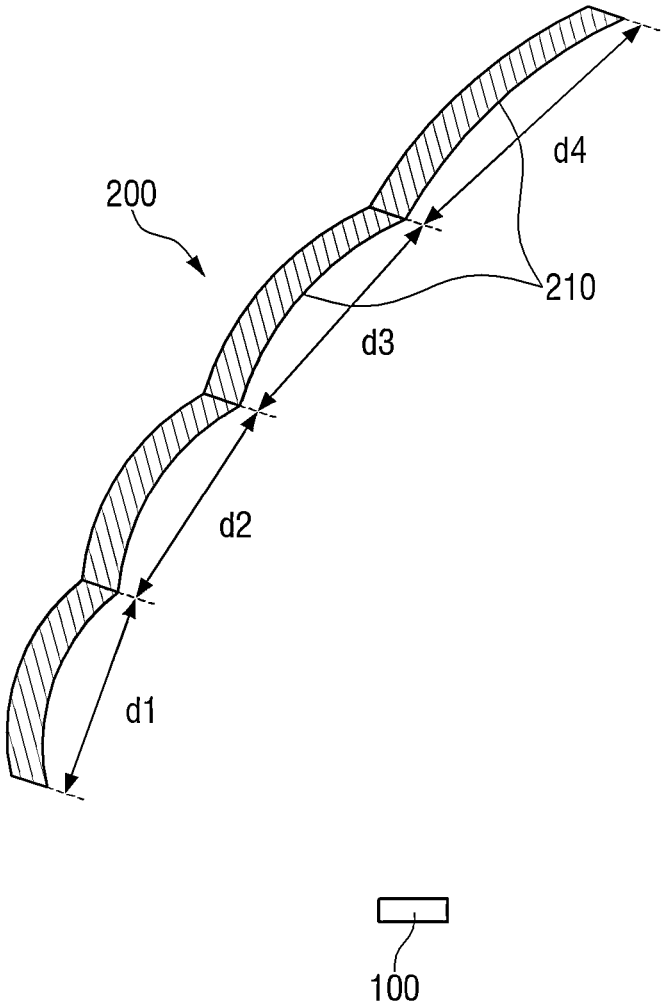

FIGS. 4 and 5 are schematic diagrams showing a plurality of reflective faces according to an implementation of the present disclosure. Referring to FIGS. 4 and 5, the angles of the plurality of reflective faces 210 according to an implementation of the present disclosure may decrease as distances between the plurality of reflective faces 210 and the light source system 100 increase. Thus, angles $\theta 1$, $\theta 2$, $\theta 3$, and $\theta 4$ of the plurality of reflective faces 210 may gradually decrease (i.e., $\theta 1>\theta 2>\theta 3>\theta 4$), so that the light beams reflected respectively from the plurality of reflective faces 210 may proceed forward, that is, in a front direction. The smaller the angle between the lines respectively connecting the front and rear ends of the reflective face to the light source system 100, the smaller an amount of light reaching the reflective face. For this reason, the plurality of reflective faces 210 may be formed such that distances d1, d2, d3, and d4 between the both opposing ends in the front and rear direction thereof gradually increase (i.e., $d1<d2<d3<d4$), depending on the distance between the plurality of reflective faces 210 and the light source system 100, such that amounts of light beams respectively reaching the plurality of reflective faces 210 may be substantially uniform.

When the amounts of the light beams emitted from the light source system 100 and respectively reaching the plurality of reflective faces 210 become uniform, the amounts of the light beams reflected respectively from the plurality of reflective faces 210 become uniform. Thus, the light irradiation pattern formed by the lamp 1 for the vehicle according to the present disclosure may have generally uniform brightness.

Each of the plurality of reflective faces 210 may reflect light beams emitted from the light source system 100 so that the light beams are concentrated on a focal point disposed in front of each of the plurality of reflective faces 210 by a predefined distance.

Figure 6:
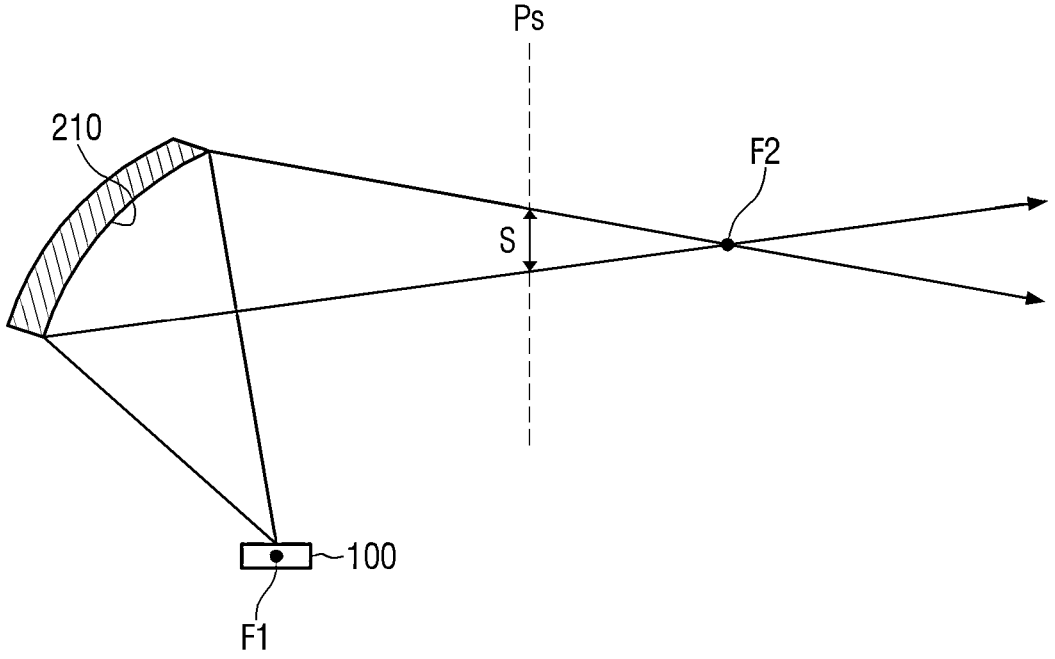
FIGS. 6-8 are schematic diagrams showing a size of a light propagation face based on a location of a second focal point of a reflective face according to an exemplary embodiment of the present disclosure.
Figure 7:
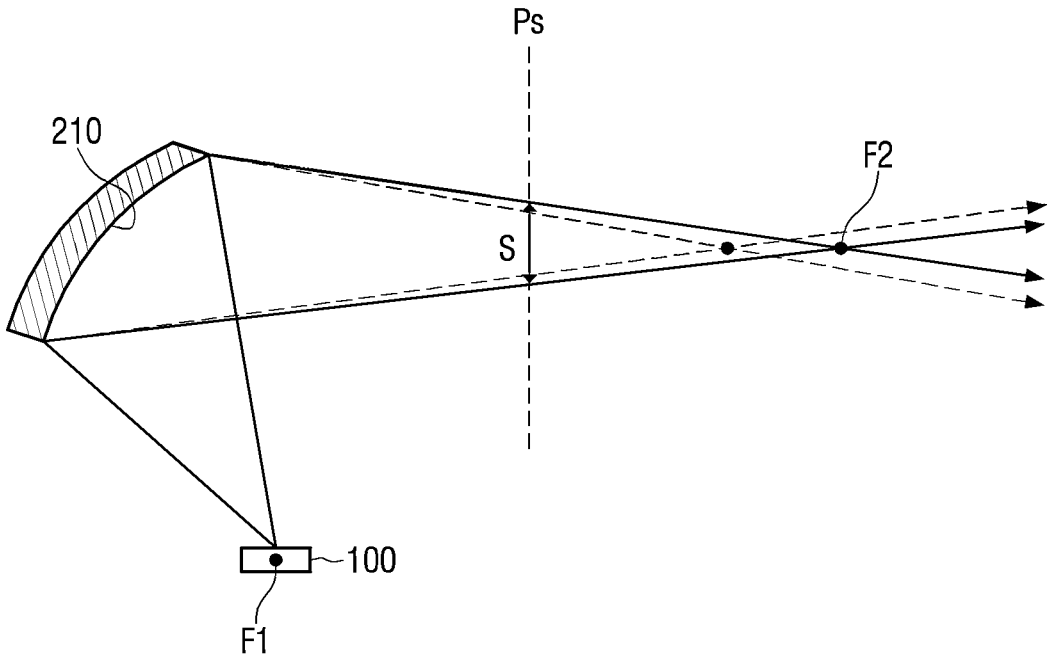
Figure 8:
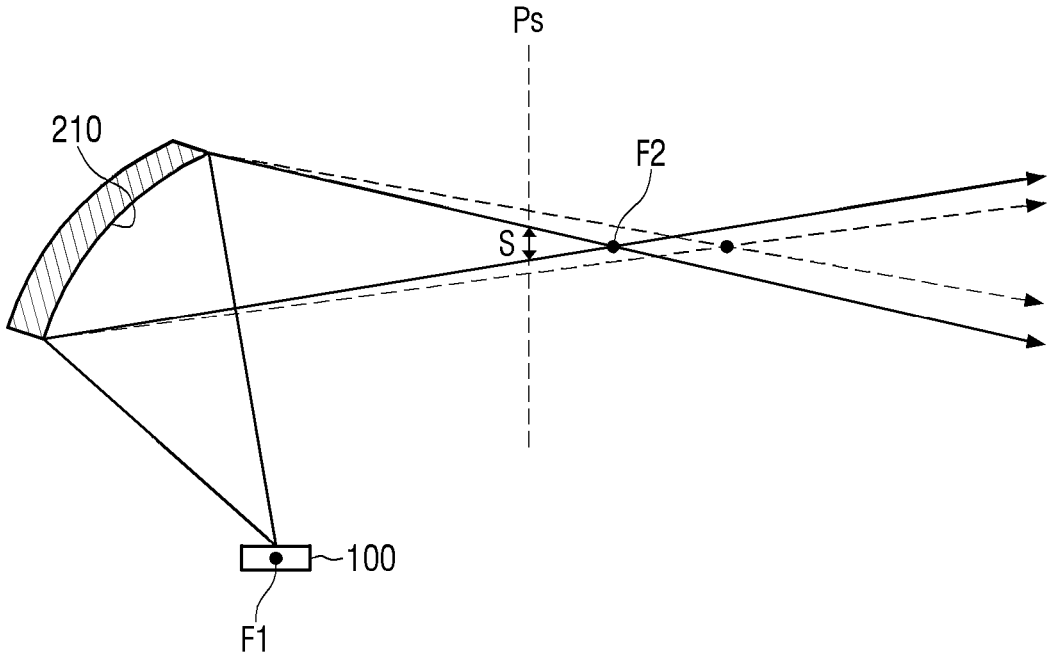

FIGS. 6-8 are schematic diagrams showing a size of a light propagation face based on a location of a second focal point of a reflective face according to an implementation of the present disclosure. FIG. 6 is an example in which one of the plurality of reflective faces 210 is shown. The description provided with regards to FIG. 6 may be applied similarly to the other reflective faces.

Referring to FIG. 6, each of the plurality of reflective faces 210 according to an implementation of the present disclosure may have a first focal point F1 and a second focal point F2. The light source system 100 may be disposed at the first focal point F1 of each of the plurality of reflective faces 210, while the second focal point F2 of each of the plurality of reflective faces 210 may be disposed in front of each of the plurality of reflective faces 210.

The size of the propagation face S through which the light reflected from each of the plurality of reflective faces 210 propagates may be determined based on a distance between the second focal point F2 and a reference position Ps. The reference position Ps may be defined as a substantially vertical plane that is spaced apart from the reflective faces 210 by a predetermined distance.

In other words, as shown in FIG. 7, when the position of the second focal point F2 is displaced farther forward from the depiction of FIG. 6, the size of the propagation face S at the reference position Ps may increase. Conversely, as shown in FIG. 8, when the position of the second focal point F2 is displaced nearer from the depiction of FIG. 6, the size of the propagation face S at the reference position Ps may become smaller. In FIGS. 7 and 8, the dotted lines indicate paths of the light reflected from the reflective face 210 in the case of the second focal point F2 as in FIG. 6, and is intended to indicate a difference between the paths of light in the cases where the second focal point F2 is displaced forward and backward from the position of the second focal point F2 in FIG. 6.

In an implementation of the present disclosure, the positions of the first focal points F1 of the plurality of reflective faces 210 may be the same, while the positions of the second focal points F2 of the plurality of reflective faces 210 may be different from one another. This is to ensure that the light irradiation pattern formed by the lamp 1 for the vehicle according to the present disclosure has a target shape or size. A detailed description thereof will be provided later.

Figure 9:
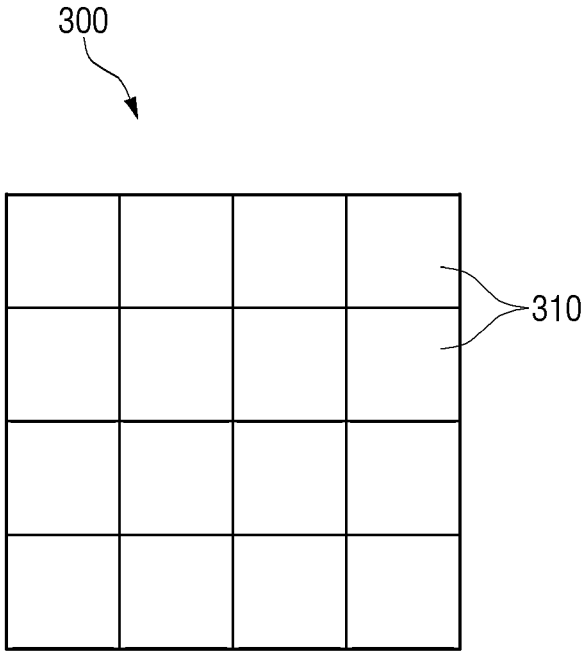
FIG. 9 is a front view showing an optical system according to an exemplary embodiment of the present disclosure.
Figure 10:
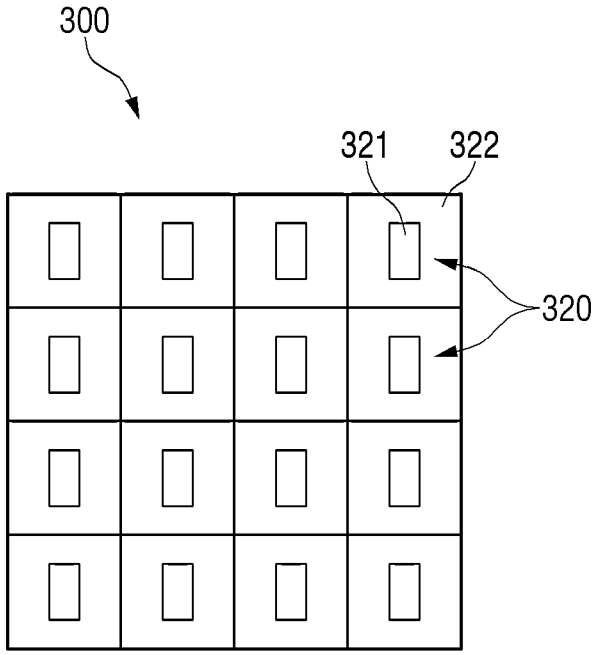
FIG. 10 is a rear view showing an optical system according to an exemplary embodiment of the present disclosure.
Figure 11:
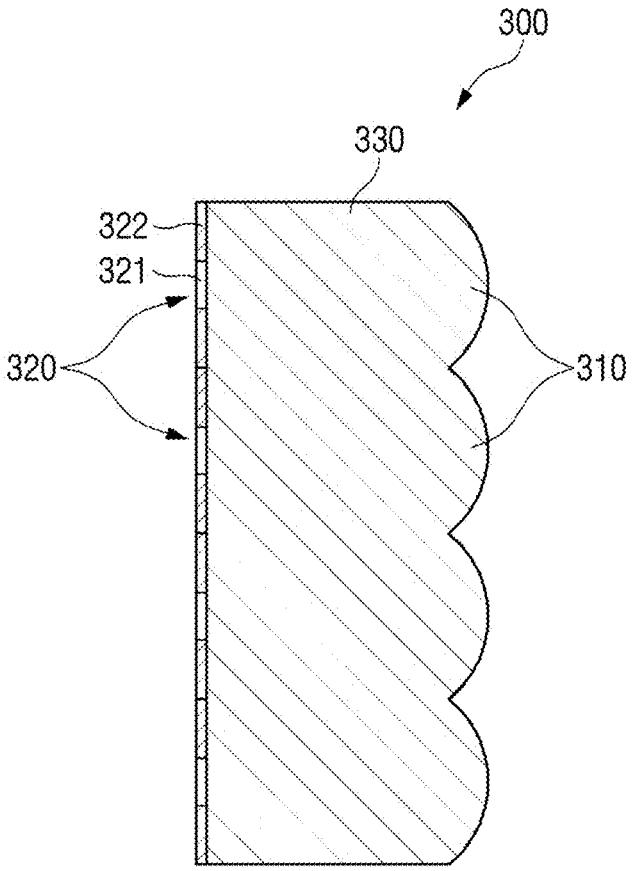
FIG. 11 is a cross-sectional view of an optical system according to an exemplary embodiment of the present disclosure.

The optical system 300 may allow at least a portion of the light reflected from the reflection system 200 to be transmitted therethrough to form a light irradiation pattern suitable for the function of the lamp 1 for the vehicle according to the present disclosure. FIG. 9 is a front view showing the optical system according to an implementation of the present disclosure. FIG. 10 is a rear view showing the optical system according to an implementation of the present disclosure. FIG. 11 is a cross-sectional view of the optical system according to implementation of the present disclosure.

Referring to FIGS. 9-11, the optical system 300 according to an implementation of the present disclosure may include a plurality of lenses 310 and a plurality of shields 320. The plurality of lenses 310 and the plurality of shields 320 may be respectively formed on both opposing surfaces of an optical member 330 made of a material through which light may transmit (e.g., glass). In an implementation of the present disclosure, each of a plurality of lenses 310 may be embodied as a micro-lens for miniaturization due to its relatively short focal point distance.

The plurality of lenses 310 may allow at least some of the light beams reflected respectively from the plurality of reflective faces 210 to transmit therethrough and be irradiated to an outside, thereby allowing the formation of the light irradiation pattern suitable for the function of the lamp 1 for the vehicle according to the present disclosure. The plurality of shields 320 may block at least some of the light beams from being directed to the plurality of lenses 310 so that the light irradiation pattern formed by the lamp 1 for the vehicle according to the present disclosure has a target shape and/or size.

In an implementation of the present disclosure, a case in which the plurality of lenses 310 are integrally formed with one another and on an exit surface of the optical member 330 is described by way of example. However, the present disclosure is not limited thereto. The plurality of lenses 310 may be individually manufactured and collectively attached to the optical member 330.

Further, the plurality of shields 320 may be formed on an incident surface of the optical member 330 using a deposition or coating method. A length (or a thickness) of the optical member 330 in the front and rear direction may be determined based on a distance between the plurality of lenses 310 and the plurality of shields 320 corresponding to the plurality of lenses 310.

Each of the plurality of shields 320 may include a transmissive region 321 through which light may transmit, and a blocking region 322 for blocking light. A shape and/or a size of the light irradiation pattern formed by the lamp 1 for the vehicle according to the present disclosure may vary depending on a shape and/or a size of the transmissive region 321.

In this connection, in order to determine the shape and/or size of the light irradiation pattern based on the shape and/or size of each of the plurality of shields 320, the size of the propagation face S of the light reflected from each of the plurality of reflective faces 210 and propagating forward should be larger than a size of the transmissive region 321. The propagation face S of light may be defined as a face formed by a bundle of light beams reflected respectively from the plurality of reflective faces 210.

A description that the size of the light propagation face S is greater than the size of the transmissive region 321 may mean that a closed curve defining the transmissive region 321 is encompassed by a closed curve defining the propagation face S of the light. The configuration that the size of the light propagation face S is greater than the size of the transmissive region 321 may be necessary because a target shape may not be formed through the transmissive region 321 when a portion of the closed curve defining the light propagation face S is disposed within the closed curve defining the transmissive region 321.

The size of the propagation face S through which the light beams reflected respectively from the plurality of reflective faces 210 propagate may vary depending on a distance between the plurality of reflective faces 210 and the plurality of shields 320 corresponding to the plurality of reflective faces 210.

Figure 12:
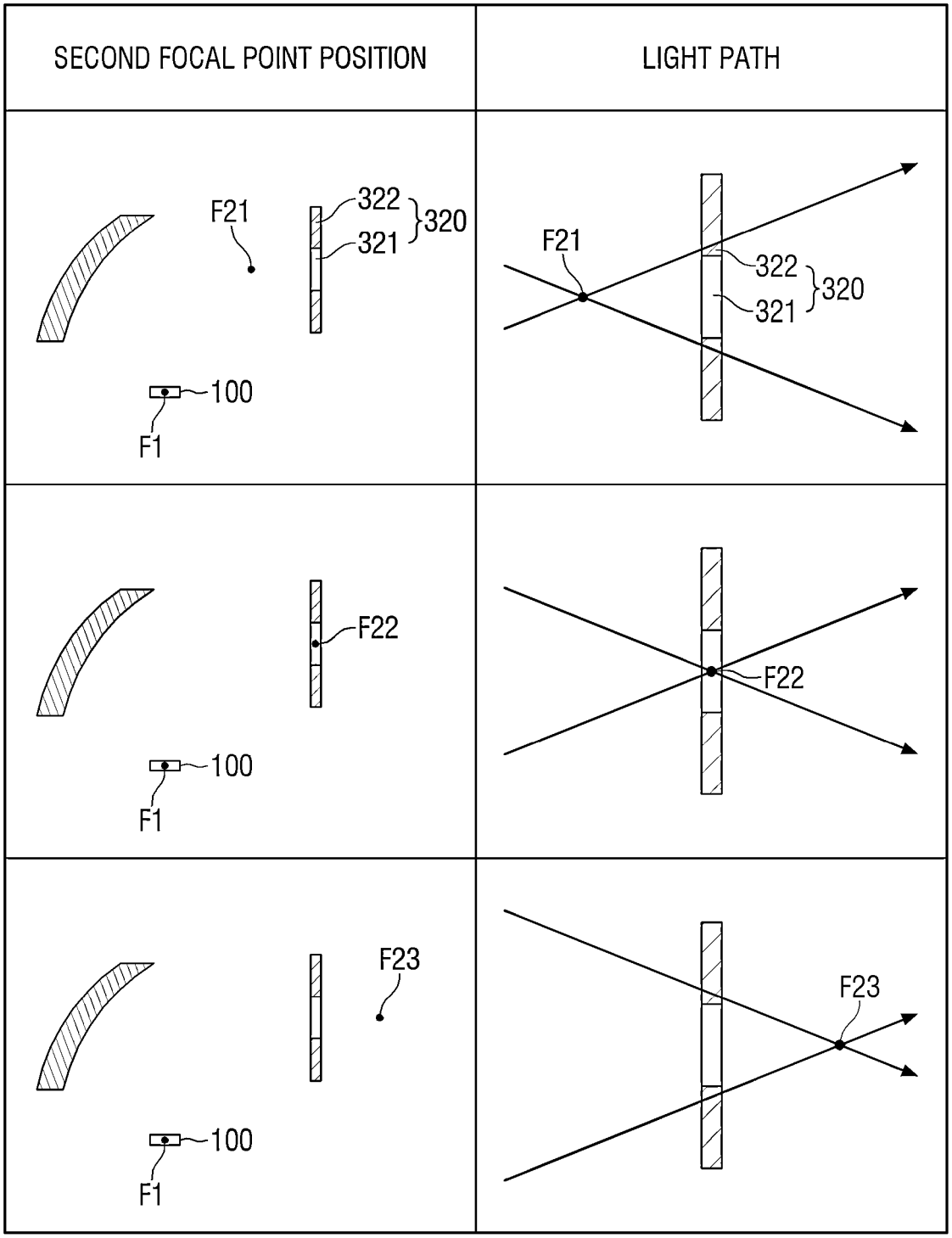
FIG. 12 is a schematic diagram showing a light path based on a location of a second focal point of a reflective face according to an exemplary embodiment of the present disclosure.

FIG. 12 schematically compares light paths depending on locations of the second focal point of a reflective face according to an implementation of the present disclosure. FIG. 12 shows a size of the propagation face and a size of the transmissive region depending on a location of the second focal point F2 by way of example. Referring to FIG. 12, the light source system 100 may be disposed at the first focal point F1 of the plurality of reflective faces 210 according to an implementation of the present disclosure. The size of the propagation face S of the light beam reflected respectively from each of the plurality of reflective faces 210 at a point where the plurality of shields 320 are disposed may vary depending on the position of each of the second focal points F21, F22, and F23 formed in front of each of the plurality of reflective faces 210.

For example, when the second focal point F21 of each of the plurality of reflective faces 210 is disposed behind the plurality of shields 320, the size of the propagation face S of the light propagating through the second focal point F21 may be greater than the size of the transmissive region 321. However, due to the relatively short focal point distance, the light diffusion may increase. As a result, an abnormal light irradiation pattern may be formed as the light beams may be directed not only to a corresponding lens among the plurality of lenses 310 but also to other adjacent lenses.

Further, when a position of the second focal point F22 of each of the plurality of reflective faces 210 coincides with a position of the plurality of shields 320, the propagation face S of light may be smaller than the size of the transmissive region 321, thereby making it difficult to form the light irradiation pattern having the target shape and/or size.

Therefore, in an implementation of the present disclosure, the second focal point may be positioned such that the size of the propagation face S of the light beam reflected from each of the plurality of reflective faces 210 and propagating forward may be larger than the size of the transmissive region 321. That is, the second focal point F23 may be positioned in front of the plurality of shields 320. This configuration may ensure that the light irradiation pattern having the target shape and/or size may be formed using the lamp 1 for the vehicle according to the present disclosure.

In an implementation of the present disclosure, one of two reflective faces adjacent to each other may be disposed in front of the other thereof. Thus, distances between the plurality of reflective faces 210 and the corresponding plurality of shields 320 may be different from each other. In this case, in order that the size of the propagation face S through which the light reflected from each of the plurality of reflective faces 210 is larger than the size of the transmissive region 321, the locations of the second focal points F2 of the plurality of reflective faces 210 may be made different from each other.

Figure 13:
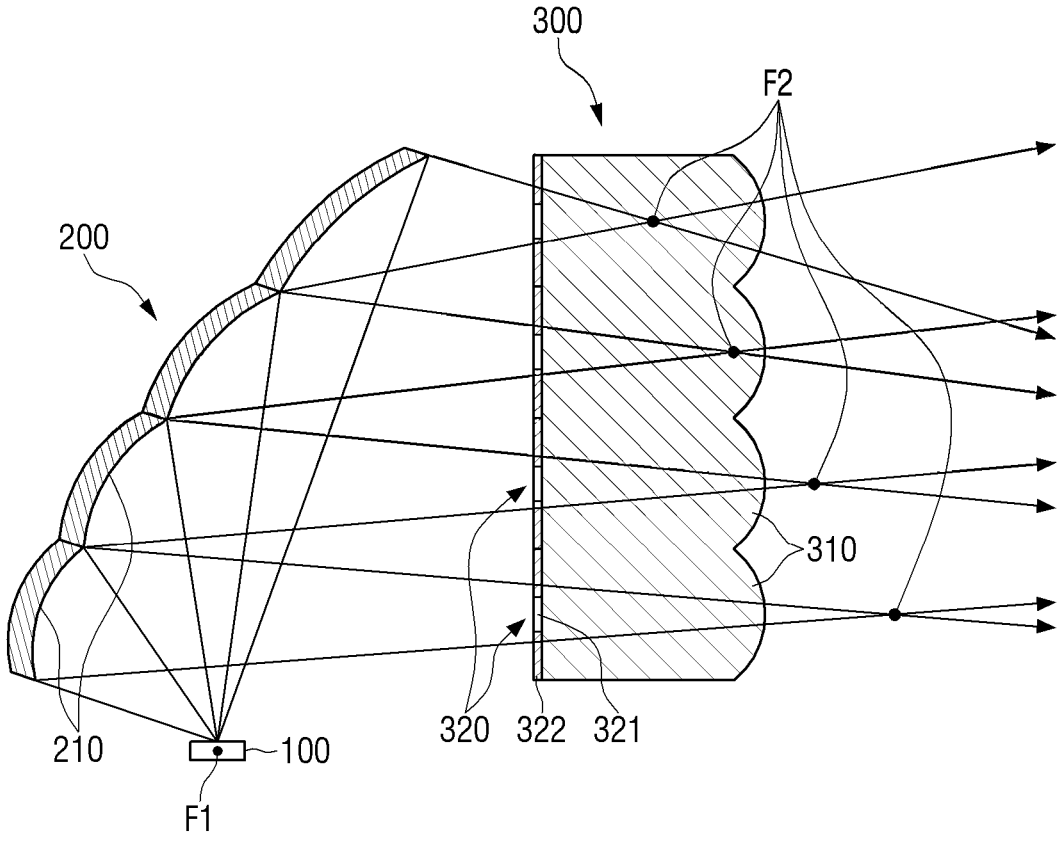
FIG. 13 is a schematic diagram showing a location of a second focal point of each of a plurality of reflective faces according to an exemplary embodiment of the present disclosure.

For example, when all of the second focal points F2 of the plurality of reflective faces 210 have the same distance, the size of the propagation face S through which the light reflected from some of the plurality of reflective faces 210 propagates may be larger than the size of the transmissive region 321, whereas the size of the propagation face S through which the light reflected from the other of the plurality of reflective faces 210 propagates may be smaller than the size of the transmissive region 321. Thus, in an implementation of the present disclosure, as shown in FIG. 13, the position of the second focal point F2 of each of the plurality of reflective faces 210 may vary depending on a distance between each of the plurality of reflective faces 210 and a corresponding shield among the plurality of shields 320 such that the size of the propagation face S through which the light reflected from each of the plurality of reflective faces 210 propagates may become larger than the size of the transmissive region 321 of each of the plurality of shields 320.

As discussed above, the plurality of reflective faces 210 may be disposed closer to the optical system 300 as the distance therefrom to the light source system 100 increases. In this connection, the distance between each reflective face 210 and the corresponding shield may become smaller. Thus, even when the focal point distance of each of the plurality of reflective faces 210, that is, the distance from each of the plurality of reflective faces 210 to the second focal point F2, decreases as the distance therefrom to the light source system 100 increases, the size of the light propagation face S may be larger than the size of the transmissive region 321.

In one example, in an implementation of the present disclosure, a case where the second focal point F2 of each of the plurality of reflective faces 210 is disposed in front of the corresponding shield among the plurality of shields 320 is described by way of example. However, the disclosure is not limited thereto. As long as the size of the propagation face S of the light is larger than the size of the transmissive region 321, and light is not directed to another lens adjacent to a corresponding lens, the second focal point F2 may be disposed in rear of the shield.

In the above-described implementation, an example in which the sizes of the transmissive regions 321 of the plurality of shields 320 are the same is described. In this case, a case where all of the positions of the second focal points F2 of the plurality of reflective faces 210 are different from one another is described by way of example. However, the disclosure is not limited thereto. When a size of the transmissive region 321 of at least some of the plurality of shields 320 is different from a size of the transmissive region 321 of at least some other of the plurality of shields 320, the plurality of reflective faces 210 may include two or more reflective faces having the same position of the second focal points F2.

When the size of the transmissive region 321 of some of the plurality of shields 320 is smaller than a size of the transmissive region 321 of some other of the plurality of shields 320, the shields 320 that have smaller transmissive region 321 may be positioned farther from the light source system 100. This is because a reflective face among the plurality of reflective faces 210 disposed farther from the light source system 100 has a smaller focal point distance, and thus an amount of the light transmitted thereto may increase even when the size of the transmissive region 321 corresponding thereto is relatively small, thereby improving the light efficiency.

In the lamp 1 for the vehicle according to the present disclosure as described above, adjusting a curvature of the exit face of each of the plurality of lenses 310 may allow regions to which the light beams exiting from the plurality of lenses 310 are irradiated to be superposed on one another, thereby forming the light irradiation pattern including a single pattern image. Alternatively, the shape and/or size of the transmissive region 321 of some of the plurality of shield 320 may be different from that of some other of the plurality of shield 320, and a direction in which light exits from some of the plurality of lenses 310 may be different from a direction in which light exits from some other of the plurality of lenses 310, such that the light irradiation pattern may include two or more pattern images.

For example, the shape and/or size of the transmissive region 321 of some of the plurality of shields 320 may be different from that of some other of the plurality of shields 320, and the curvature of the exit face of each of the plurality of lenses 310 may be adjusted so that the light beams are respectively irradiated from the plurality of lenses 310 in a plurality of different directions. Thus, a light irradiation pattern including a plurality of different pattern images P1 and P2 may be formed on the road surface around the vehicle as shown in FIG. 14.

Figure 14:
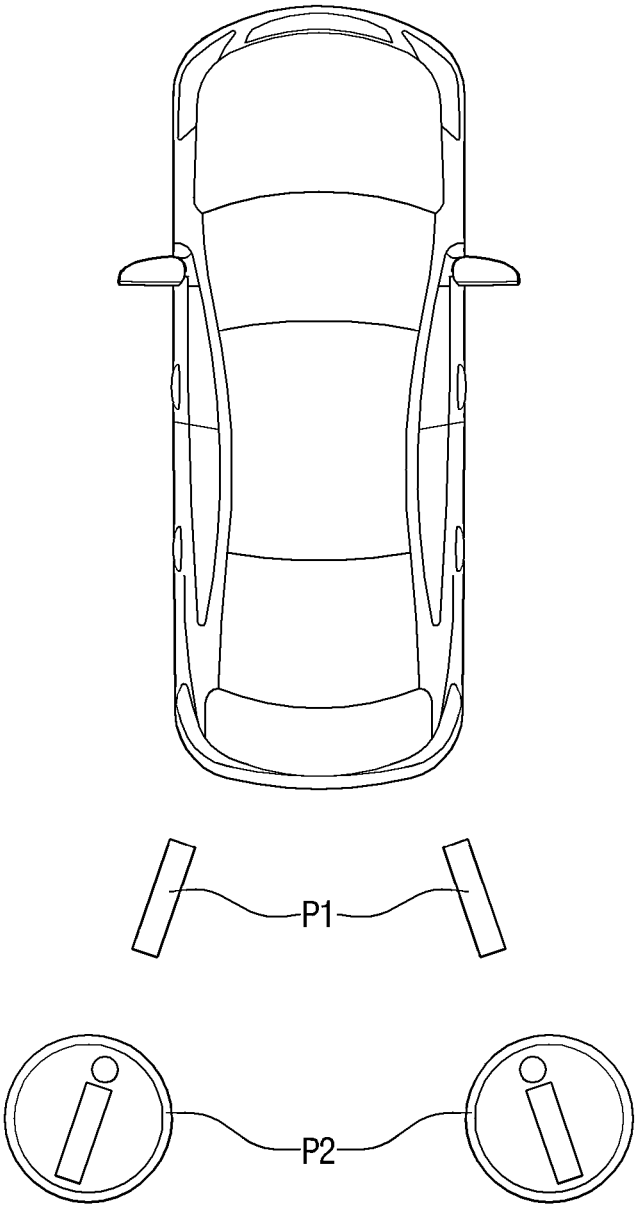
FIG. 14 is a schematic diagram showing a light irradiation pattern formed by a lamp for a vehicle according to an exemplary embodiment of the present disclosure.

FIG. 14 shows an example of a lamp by which a nearby vehicle or a pedestrian approaching a present vehicle from rear of or a side of the present vehicle may easily recognize the vehicle's backing. However, the disclosure is not limited thereto. The present disclosure may be applied similarly to a case of informing surrounding vehicles or pedestrians of a driving state of the present vehicle such as changing of lanes and opening of doors.

In one example, in the above implementation, a case in which the plurality of lenses 310 and the plurality of shields 320 are respectively formed on both opposing surfaces of the optical member 330 is described by way of example. However, the disclosure is not limited thereto. The optical system 300 may further include an optical element which may be made of a material through which light transmits and may be disposed to face toward an incident surface of the optical member 330.

Figure 15:
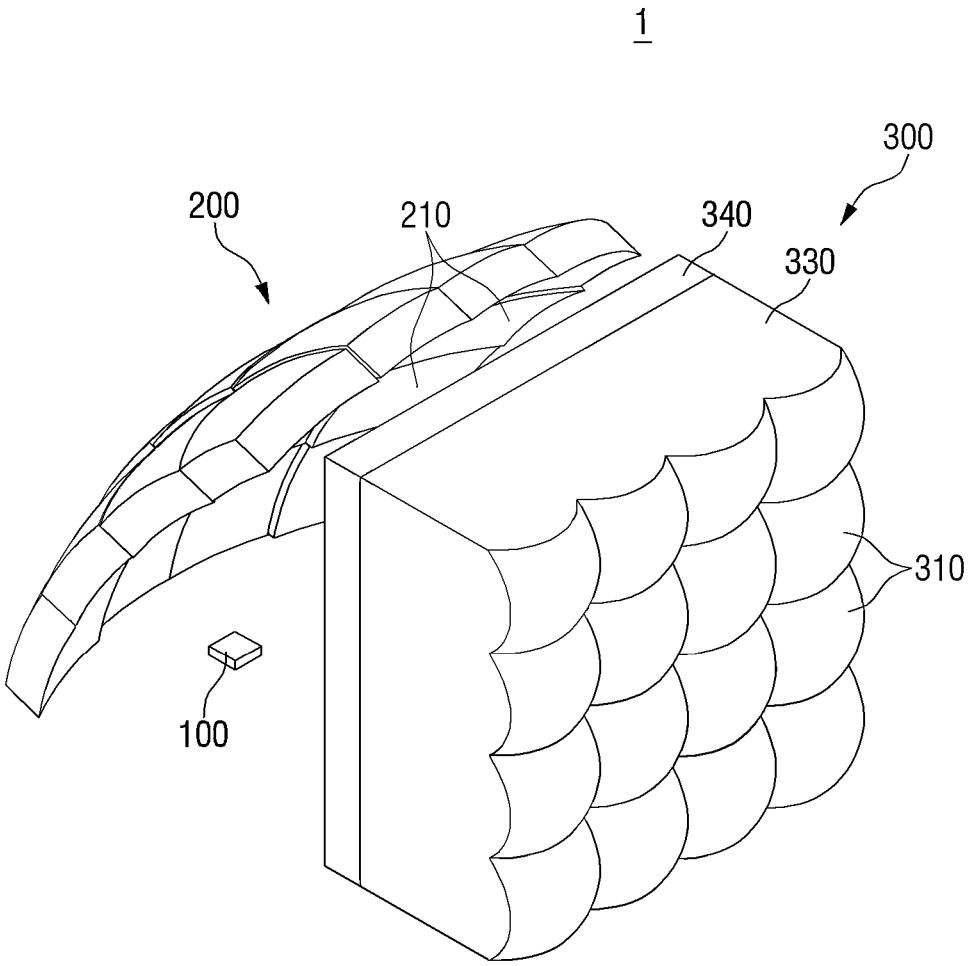
FIGS. 15 and 16 are perspective views showing a lamp for a vehicle according to another exemplary embodiment of the present disclosure.
Figure 16:
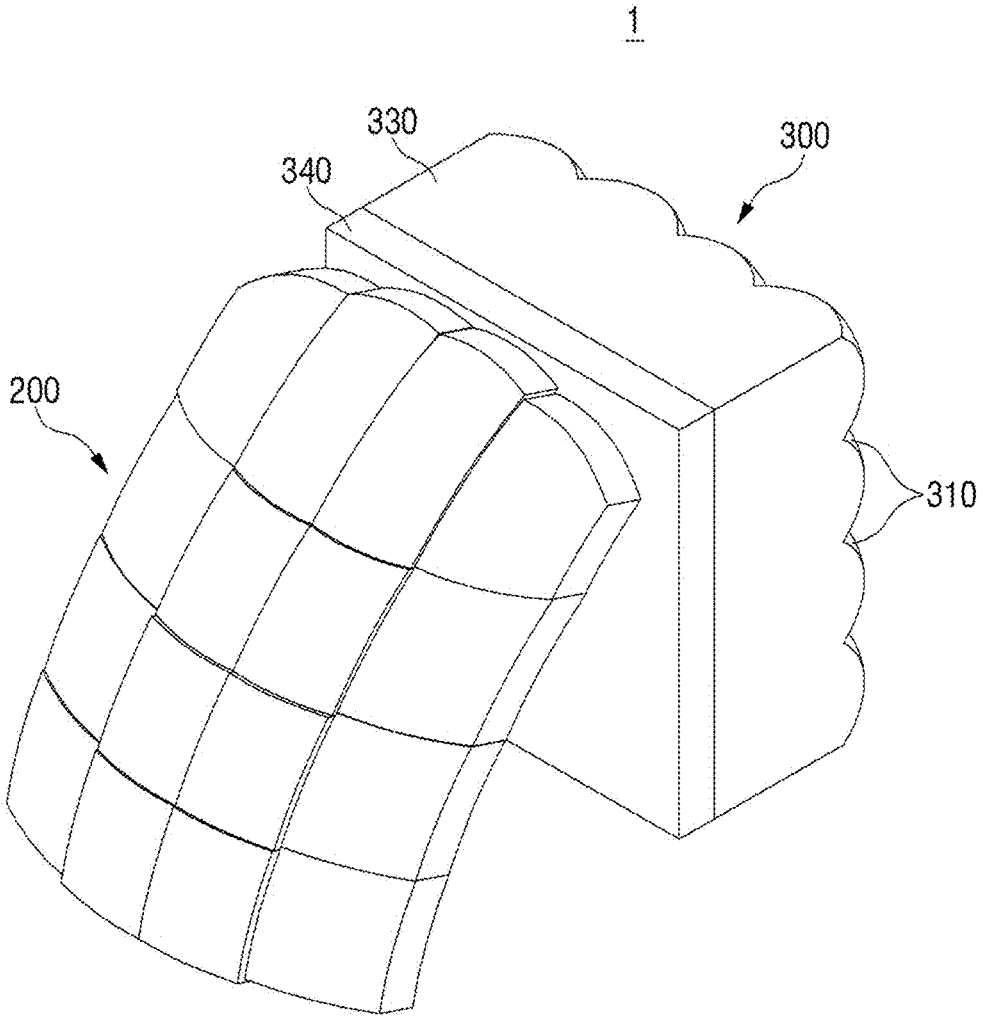
Figure 17:
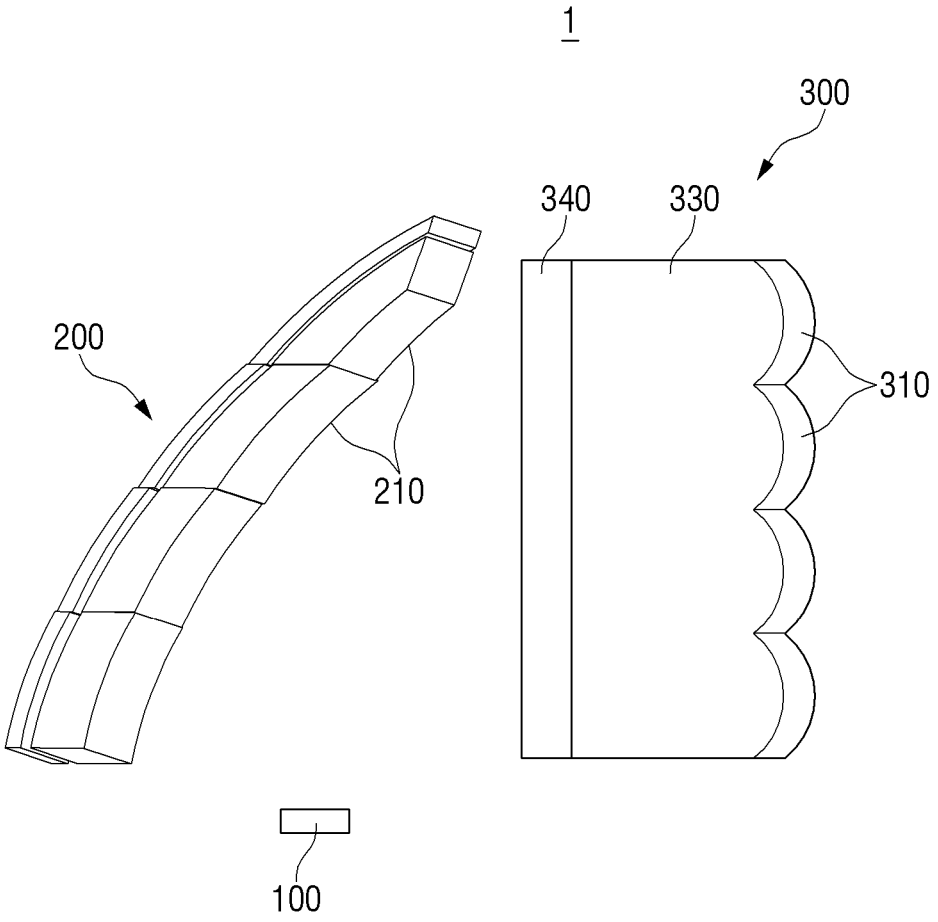
FIG. 17 is a side view showing a lamp for a vehicle according to another exemplary embodiment of the present disclosure.

FIGS. 15 and 16 are perspective views showing a lamp for a vehicle according to another implementation of the present disclosure. FIG. 17 is a side view showing a lamp for a vehicle according to another implementation of the present disclosure. Referring to FIGS. 15-17, a lamp 1 for a vehicle according to another implementation of the present disclosure may include the light source system 100, the reflection system 200, and the optical system 300 in a similar configuration to that of the foregoing implementation.

In another implementation of the present disclosure, components that serve the same functions as those in the above implementation may have the same reference numerals. Detailed description thereof will be omitted.

In another implementation of the present disclosure, the optical system 300 may further include a light transmitter 340 disposed so that an exit surface thereof faces toward the incident surface of the optical member 330 onto which the light reflected from the reflection system 200 is incident. In another implementation of the present disclosure, the light transmitter 340 may be in close contact with the incident surface of the optical member 330 so as to prevent the positions of the plurality of shields 320 formed on the optical member 330 from being deviated from the predetermined positions.

As described above, in the lamp 1 for the vehicle according to the present disclosure, each of the plurality of reflective faces 210 may direct the light emitted from the light source system 100 to each of the plurality of lenses 210. Thus, a component such as a collimator lens for adjusting the path of the light emitted from the light source system 100 may be omitted, such that the configuration of the lamp 1 may be simplified.

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. A lamp for a vehicle, the lamp comprising:

a light source system;

a reflection system including a plurality of reflective faces to reflect light beams emitted from the light source system to travel forward; and an optical system including a plurality of lenses respectively corresponding to the plurality of reflective faces, wherein the optical system is configured to transmit at least a portion of light reflected from each of the plurality of reflective faces through a corresponding lens among the plurality of lenses to form a predetermined light irradiation pattern, wherein the plurality of reflective faces of the reflection system include at least a first reflective face, a second reflective face, and a third reflective face, wherein the first reflective face is disposed farther from the light source system than the second reflective face, and the second reflective face is disposed farther from the light source system than the third reflective face, wherein the plurality of lenses of the optical system include at least a first lens corresponding to the first reflective face, a second lens corresponding to the second reflective face, and a third lens corresponding to the third reflective face, wherein a first distance between the first reflective face and the first lens is smaller than a second distance between the second reflective face and the second lens, and the second distance is smaller than a third distance between the third reflective face and the third lens, wherein a first length between front and rear ends of the first reflective face is greater than a second length between front and rear ends of the second reflective face, and the second length is greater than a third length between front and rear ends of the third reflective face, whereby amounts of the light beams respectively reaching the first reflective face, the second reflective face, and the third reflective face are substantially uniform, and wherein a first focal distance between the first reflective face and a front focal point of the first reflective face is smaller than a second focal distance between the second reflective face and a front focal point of the second reflective face, and the second focal distance is smaller than a third focal distance between the third reflective face and a front focal point of the third reflective face.

2. The lamp of claim 1, wherein each of the plurality of reflective faces is configured such that as a distance between each reflective face and the light source system increases, an angle defined by a line connecting a front end of the each reflective face to the light source system and a line connecting a rear end of the each reflective face to the light source system decreases.

3. The lamp of claim 1, wherein the light source system is disposed at a rear focal point of the plurality of reflective faces.

4. The lamp of claim 3, wherein the optical system further includes a plurality of shields for blocking some of the light beams from being respectively directed to the plurality of lenses.

5. The lamp of claim 4, wherein each of the plurality of shields includes a transmissive region through which light transmits; and a blocking region to block light, and wherein a position of a front focal point of each of the plurality of reflective faces is determined based on a size of the transmissive region.

6. The lamp of claim 5, wherein the front focal point of each of the plurality of reflective faces is disposed such that a size of a propagation face through which light reflected from each of the plurality of reflective faces is propagated is larger than the size of the transmissive region.

7. The lamp of claim 6, wherein the front focal point of each of the plurality of reflective faces is disposed such that a closed curve defining the transmissive region is encompassed by a closed curve defining the propagation face.

8. The lamp of claim 4, wherein the front focal point of at least one of the plurality of reflective faces is disposed in front of a corresponding shield among the plurality of shields.

9. The lamp of claim 4, wherein at least one of a size or a shape of the transmissive region of some of the plurality of shields is different from some other of the plurality of shields.

10. The lamp of claim 4, wherein a size of the transmissive region of some of the plurality of shields is smaller than some other of the plurality of shields, and wherein, among the plurality of shields, a first shield that has a smaller transmissive region than a second shield is disposed farther from the light source system than the second shield.

11. The lamp of claim 4, wherein the optical system further includes an optical member having an incident surface and an exit surface, wherein the plurality of shields are formed on the incident surface thereof, while the plurality of lenses are formed on the exit surface thereof, and wherein a length of the optical member in a front and rear direction is determined based on a distance between the plurality of lenses and the plurality of shields corresponding to the plurality of lenses.

12. The lamp of claim 11, wherein the optical system further includes a light transmitter disposed in rear of the optical member, wherein an exit surface of the light transmitter is in contact with the incident surface of the optical member.

13. The lamp of claim 12, wherein the plurality of shields are interposed between the exit surface of the light transmitter and the incident surface of the optical member.

14. The lamp of claim 1, wherein the optical system is configured to output the light beams in a plurality of different directions so that the light irradiation pattern includes a plurality of pattern images formed at different positions.

15. The lamp of claim 14, wherein exit surfaces of the plurality of lenses of the optical system have different curvatures based on directions in which the light beams exit therefrom.

* * * * *